United States Patent [19]

Schopf

[11] 4,098,209

[45] Jul. 4, 1978

[54] THREAD CUTTER FOR CHAINSTITCH SEWING MACHINE

[75] Inventor: Dieter Schopf, Gerlingen, Fed. Rep. of Germany

[73] Assignee: Union Special G.m.b.H., Stuttgart, Fed. Rep. of Germany

[21] Appl. No.: 808,502

[22] Filed: Jun. 21, 1977

Related U.S. Application Data

[63] Continuation-in-part of Ser. No. 717,064, Aug. 24, 1976, abandoned.

[51] Int. Cl.[2] ..... D05B 65/02

[52] U.S. Cl. ..... 112/298; 112/199

[58] Field of Search ..... 112/296, 297, 298, 291, 112/292, 288, 130, 199, 286

[56] References Cited

U.S. PATENT DOCUMENTS

| | | | |
|---|---|---|---|
| 1,491,010 | 4/1924 | Hleb | 112/296 |
| 2,176,836 | 10/1939 | DeVoe | 112/296 X |
| 3,386,402 | 6/1968 | Ross | 112/292 |
| 3,405,672 | 10/1968 | Ross | 112/296 |
| 3,424,115 | 1/1969 | Schopf | 112/296 |
| 3,424,117 | 1/1969 | Schopf | 112/292 |
| 3,871,307 | 3/1975 | Scott et al. | 112/296 X |
| 3,901,171 | 8/1975 | Rosa | 112/286 |

*Primary Examiner*—H. Hampton Hunter

*Attorney, Agent, or Firm*—John W. Harbst; John A. Schaerli

[57] ABSTRACT

A cylinder bed machine provided with a thread cutting device having a retractable and laterally movable assemblage which includes a thread seizing member, a knife and a thread clamp. Upon actuation the assemblage cooperatively moves forwardly and laterally to a predetermined distance from the stitching area whereat the knife and thread clamp are held. The thread seizing member continues forward movement to a position for seizing the threads situated about the looper. Upon return, the seizing member carries the threads to the knife and thread clamp position whereat they are cut and clamped. Once the threads are cut and clamped the assemblage is returned to its initial position. An adjustable guide directs the seizing member through the thread loops formed about the looper.

14 Claims, 5 Drawing Figures

PRIOR ART

THREAD CUTTER FOR CHAINSTITCH SEWING MACHINE

CROSS REFERENCES

This invention is a Continuation-In-Part of my application, Ser. No. 717,064 filed Aug. 24, 1976, now abandoned.

BACKGROUND OF THE INVENTION

This invention relates to cylinder bed sewing machines and more particularly to a thread trimming mechanism therefor.

Thread cutters for sewing machines are well known in the art. It is also well known in the art to provide thread cutters wherein the trimming mechanism is movable between the top side of the looper and the underside of the throat plate. An example of these type thread cutters are shown in U.S. Pat. Nos. 3,424,115 and 3,424,117 to D. Schopf and granted Jan. 28, 1969. It is also known in the art to equip a cylinder bed machine with a thread cutter. An example of the foregoing being set forth in a machine manufactured by Union Special G.m.b.H. and sold as a style 33700 KE or KG machine.

In view of the space constraints within the cylinder bed of the present machine it has been found that a linear looper drive has advantages over a pivotally mounted looper. Some of the advantages of employing a linear drive as compared with a pivotally mounted looper being that the drive for same may be remote from the looper itself, and the linear drive is a direct drive and does not require a plurality of linkages to deliver the driving force to the looper. The above identified patents, as well as most of the sewing machine industry, has heretofore employed pivotally driven looper assemblies. However, when a looper mechanism is changed from pivotal motion to linear motion as disclosed in the present invention, certain demanding constraints are placed on other mechanisms of the machine.

As particularly applicable to the present invention, the changeover from a pivotally movable looper to a linear moving looper greatly effects the path of movement for the thread trimming mechanism. That is, the path of movement of the thread mechanism, which in turn influences the effectiveness of the trimming mechanism, must be such that the thread loop depending from the workpiece and situated about the looper must be positively severed in order to produce an acceptable garment. In this regard, one of the constraints in a trimming mechanism for chainstitch machines is that said mechanism must approach the depending thread loop with a path of travel generally parallel with the motion of the looper in order to assure that the loop is affected. This parallelism approach is even more important when the invention is employed with a multiple needle machine wherein each of the depending loops has to be affected to insure an acceptable garment. As may be appreciated, if it were proposed in a multiple needle machine to angularly offset the approach of the trimming mechanism to the thread loops the chance of missing any number of the loops is greatly enhanced due to the inclination of approach with respect to the loops of thread.

The thread cutters shown in the two above identified patents do not lend themselves to the present invention for the following reasons. Both of the patented devices require that the pivot point of the cutting assembly be sufficiently displaced from the stitch forming area so as to impart to the cutter blades an arcuate path having a sufficient linear approximation so as to assure that the blade passes through the center of the thread loops formed about the looper as has been heretofore discussed. When employing multiple needle machines, as may be the case with the present invention, the problem is enhanced because the thread loops are spaced along the longitudinal axis of the looper and thus the distance between the pivot point and the arcuate path travelled by the cutter blade has to be extended to insure that the blade will have a sufficient linear approximation so as to enter all of the thread loops. As mentioned above, the present invention is embodied in a cylinder bed machine wherein the base casting or cylinder bed does not lend itself to sufficient room enabling displacement of a pivot point a removed distance from the stitching area through which the cutting blade must travel. Therefore, the thread cutters shown in these patents do not readily lend themselves to incorporation within the machine of the type hereunder consideration.

Turning now to the embodiment of a straight line thread cutter as employed in the above mentioned class 33700 machines, it may be seen why a thread cutter of this sort is most difficult to incorporate within the cylinder bed machine of the present invention. It should be pointed out, that a Class 33700 KE or KG machine is provided with a pivotally moving looper assembly. The trimming mechanism on said machine is placed in a parallel aligned relationship with the path travelled by the looper. The trimming mechanism is capable of being situated in this position because the arcuate path of the looper, and more particularly the arcuate path of the heel of the looper, passes under the removed or non-cutting position of the trimming mechanism and thus allows close access of the mechanism to the stitch forming instrumentalities without any interference resulting. However, in the present invention, there is employed a linearly moving looper. In this respect if the trimming mechanism embodied in the present invention were situated in a parallel aligned relationship with the path travelled by the looper, as is disclosed in the above mentioned machine, an interference between the path travelled by the heel of the looper and non-cutting position of the trimming mechanism would occur. Therefore, the trimming mechanism as is disclosed in a Class 33700 machine does not lend itself to the present invention.

In summation, the constraints inherent with a cylinder bed machine employing a linear moving looper requires that the trimming mechanism approaches the needle thread loops in a path generally parallel and aligned with the looper path while at the same time the non-cutting position of the trimming mechanism must lie sufficiently away from the linear path of the heel of the looper so as to avoid any interferences between the looper mechanism and the trimming mechanism. For the reasons discussed hereinabove, the art heretofore known does not readily lend itself to such an application.

SUMMARY OF THE INVENTION

In view of the above, and in accordance with the present invention there is provided a thread trimming mechanism which serves the purpose of severing the threads in a cylinder bed machine having a looper with a linear path of motion.

The problem of overcoming all of the heretofore mentioned constraints essentially is solved by providing a thread cutting device which has a retractable and laterally movable assemblage which includes a thread siezing member, a knife and a thread clamp. The present invention contends with the cylinder bed space constraints by imparting to the trimming mechanism a straight line motion whereby assuring severance of any and all thread loops while at the same time overcoming the constraint of a linear moving looper and the interference effects inherent therewith, as was discussed above, by laterally shifting the trimming mechanism to a noncutting position removed from the linear path of the looper. When severance of the thread loop is required, the thread trimming assembly is shifted forwardly and laterally into an aligned parallel relationship with the path of the looper only for the extent of time necessary for severance of the thread loops. At first, the thread trimming assembly cooperatively moves forward and laterally to a predetermined point whereat the knife and thread clamp are held. While the knife and thread clamp are held a predetermined distance from the needle the thread seizing member continues forward movement to a position in continued parallel alignment with the looper path for seizing the threads situated about the looper. Upon return movement the threads are carried by the seizing member to the knife and thread clamp position whereat they are cut and clamped and then the entire trimming assemblage is returned to the removed noncutting position whereat the trimming assembly is removed from the path of the linear moving looper. The present invention further provides an adjustable guide for accurately guiding and positioning the seizing member through the thread loops which are formed about the looper. With a design and arrangement of the type herein described, it is possible to arrange a thread severing mechanism in the limited space inherent with cylinder bed machines while at the same time retain the thread trimming mechanism in a position removed from the linear path of the looper when the sewing cycle is again started.

It is therefore an object of this invention to provide a thread severing mechanism which in its non-cutting position is removed from the linear path of the looper but is movable into parallel alignment with the looper path when necessary to cut a predetermined series of threads at a point whereat the length of thread thereof is satisfactory for the start of the sewing cycle.

It is a further object of this invention to provide means for assuring seizement of the thread loops whereby assuring severance of all the loops displaced about the looper.

Further objects and advantages of this invention will become apparent from the description now to follow of the preferred embodiment thereof shown by way of example in the accompanying drawings, in which.

DETAILED DESCRIPTION OF THE PREFERRED EMBODIMENT

Figure 2:
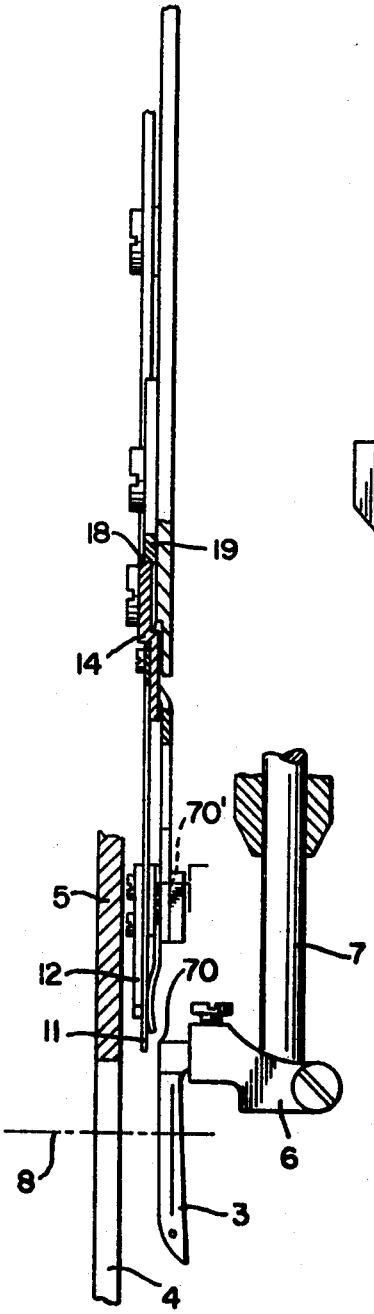
FIG. 2 is a partial cross sectional view taken along line 2—2 of FIG. 1.
Figure 1:
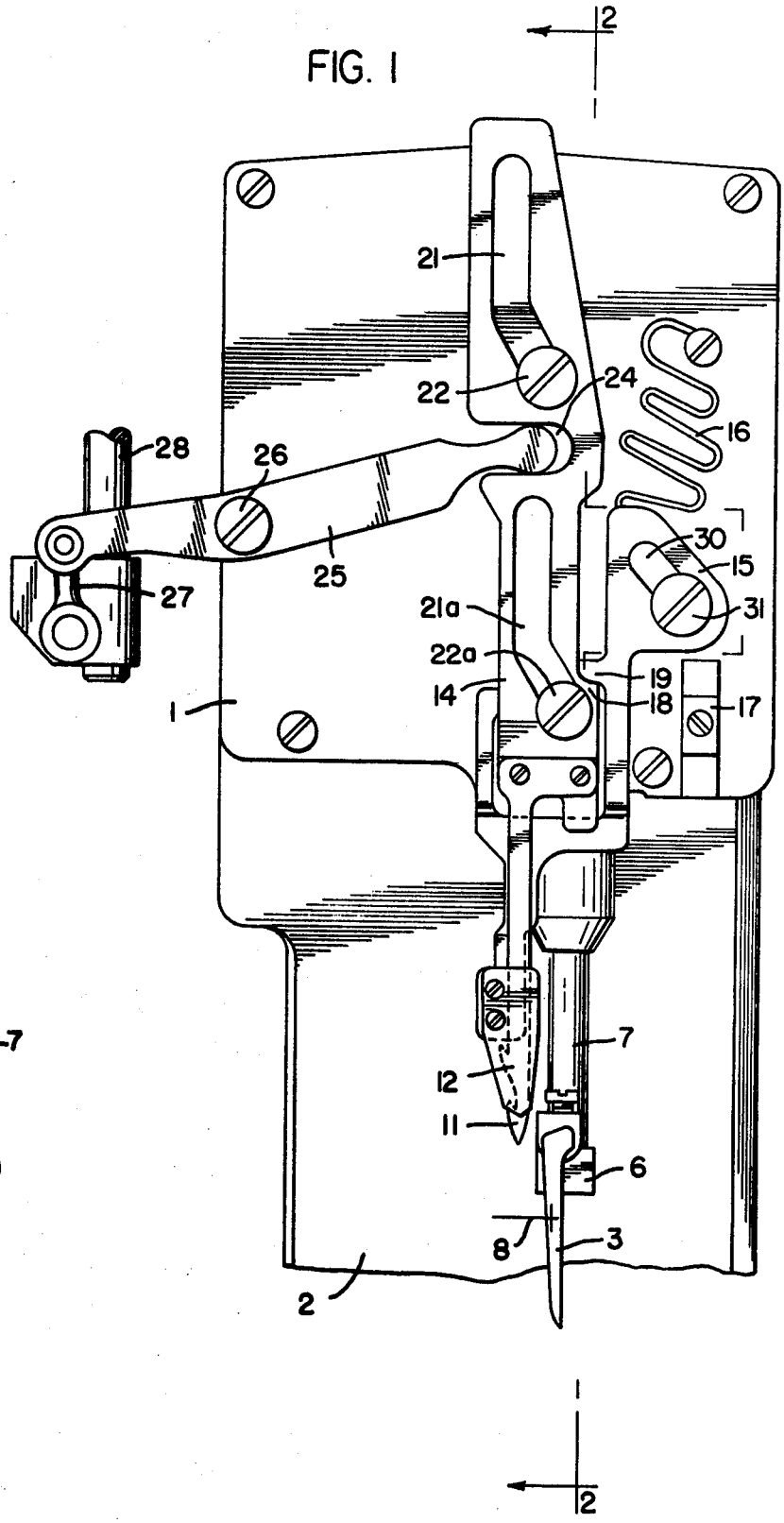
FIG. 1 is a partial top view of the machine incorporating the present invention and showing the thread severing mechanism in a non-cutting position.

Referring now to the drawings, and more particularly to FIGS. 1 and 2, the present invention is shown embodied in a sewing machine having a machine bed means 1. Extending from the machine bed means 1 is a work supporting arm means 2 which in the present invention is in the form of a cylinder bed support means. The machine is further provided with a needle bar (not shown) and needle means (not shown) which are driven in any suitable manner. The needle means cooperates with a thread carrying looper means 3 for effecting chain stitches. As will hereinafter be described, the looper means 3 is movable in a linear or axial direction beneath the needle plate means 4 which is suitably secured to a workpiece rest means 5. The looper means 3 is secured within a bracket means 6 which in turn is suitably secured to a looper bar drive means 7 operable in a linear direction generally perpendicular to the needle center line and generally known in the art as an across-the-line of feed machine, however, it should be appreciated that the thread cutting mechanism of the present invention is equally applicable, at least in part, to other types of sewing machines. The present invention is readily applicable for use with a multiple needle machine, however, for reasons of simplicity there is shown in the drawings a centerline, designated by the numeral 8, which is schematically representative of the path of a single needle. In addition to the longitudinal motion imparted to the drive bar means 7 the latter is also pivotally moved about its longitudinal axis so as to impart to the looper means 3 the necessary looper avoid motion required for across-the-line of feed machine. As is apparent, these elements, as well as the feed mechanism (not shown) which lies in the machine bed, are well known in the industry and thus no further description will be devoted thereto.

Figure 3:
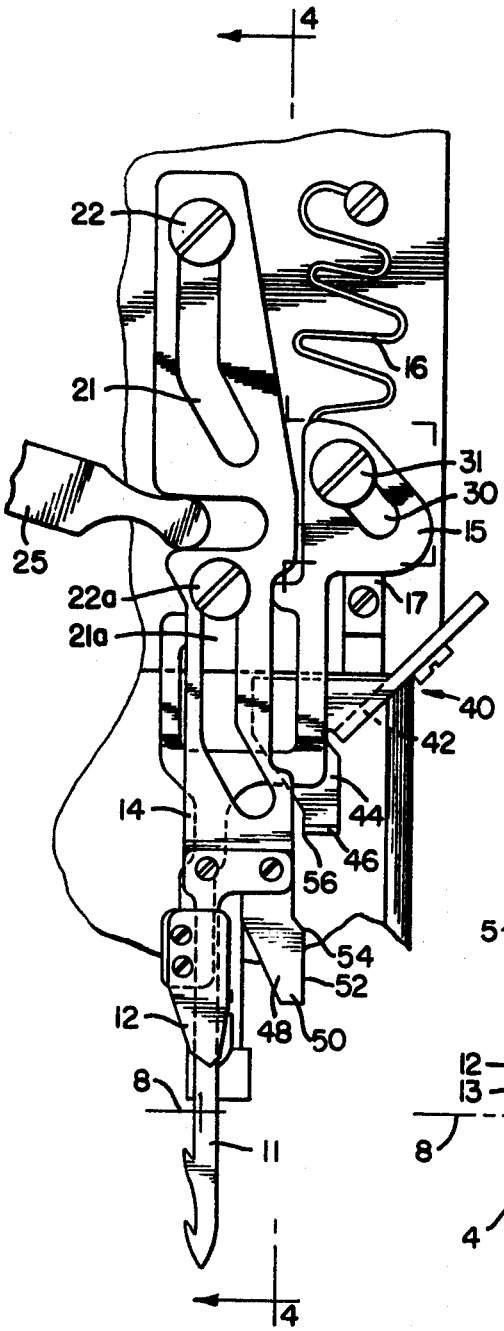
FIG. 3 is a partial top view of a slightly different embodiment showing the thread severing means in the extended position.

The thread severing mechanism of the present invention will now be described. In the illustration shown in FIGS. 1 and 2, the thread severing mechanism is shown in a non-cutting position. The thread severing mechanism of the present invention is a retractable and laterally movable assemblage which includes a thread catching means 11 which operates together with a knife means 12 and a thread clamp or nipper means 13 and is guided therebetween. Preferably, the thread catching means 11 is connected to, and is moved toward and from the sewing area by a slideable guide or reciprocal support means 14. The knife means 12 and the thread clamp means 13 are secured to a carrier or transporter means 15 which is cooperatively movable with, but yet independent from, the reciprocal support means 14. The transporter means 15 is in engagement with a resilient member means 16, which in the preferred embodiment is shown as an anchored compressive spring means. Upon forward movement of the reciprocal support means 14 the spring means moves the carrier means 15 from the non-cutting position shown in FIG. 1 forwardly and, as will hereinafter be discussed, laterally until the carrier means 15 abuts against a stop means 17 as shown in FIG. 3. The stop means 17 is secured to the bed of the machine by any suitable means. The spring means 16 and the stop means 17 cooperate to position and maintain the knife means 12 and the nipper means 13 in a cutting position which is a predetermined distance from the centerline 8 of the needle means.

Both the reciprocal support means 14 and the transporter means 15 are provided with angled guide slot means. It should be noted that the angled length and inclination of these slots with respect to the needle centerline are equal, so that when moved into a cutting position, the above mentioned elements can effectively cooperate together in effectively severing the threads. The guide means 14 is provided with slot means 21 and 21*a* while the transporter means 15 is provided with a slot means 30. Screw means 22 and 22*a*, which are suitably secured to the bed 1 of the machine, coact with slot means 21 and 21*a* respectively for cooperatively controlling the movement of the reciprocal support means 14. A drive lever means 25, which can be swung about an articulate connection 26 is connected by a link means 27 to a draw bar means 28 which in turn is connected to a driving unit (not shown), for an example, an electromagnet. The drive lever means 25 may be connected in any suitable manner, such as at 24, with the guide means 14. As mentioned above, the transporter means 15 is provided with a slot means 30 which cooperates with engaging screw means 31 so as to impart a forward and lateral movement to the member means 15 for reasons discussed hereinafter.

As may be best seen in FIGS. 1 and 2, the carrier means 15 is provided with a projecting finger means 19 while the reciprocal support means 14 is provided with a shoulder means 18. While in the non-cutting position the finger means 19 is in an abutting relationship (FIG. 2) with the shoulder means 18 on the carrier means 15. The reciprocal support means 14 through the abutment between projecting finger means 19 and shoulder means 18 holds the transporter means 15 in a non-cutting position under the influence of lever means 25.

OPERATION OF THE MECHANISM

At first, when the thread trimming mechanism is in a non-cutting position as shown in FIG. 1, the screw means 22, 22*a* and 31 lie at the extreme forward position of the slot means 21, 21*a* and 30 so that upon actuation the reciprocal support means 14 and the carrier means 15 can travel forwardly a distance equal to the longitudinal component of their respective slot means. The reciprocal support means 14 is driven upon movement of the drive lever means 25. During initial movement the reciprocal support means 14 is both forwardly and laterally moved with respect to the needle center line 8. The lateral movements occur as long as the angled portion of the slot means 21 and 21*a* engages the screw means 22 and 22*a*.

Figure 4:
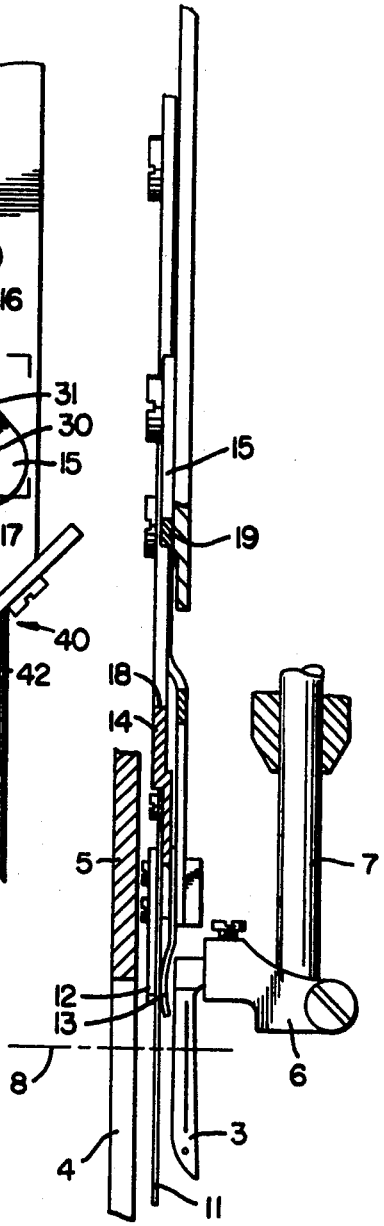
FIG. 4 is a partial cross sectional view as taken along line 4—4 of FIG. 3.

As may be best seen in FIG. 4, once the slideable guide means 14 is moved forward the abutting shoulder means 18 on the slideable guide means 14 is carried away from the projecting means 19 on the carrier means 15. This is to say that the movement of the slideable guide means is independent but yet controlling of the cooperative movement of the carrier means 15. Once the abutting relationship is removed the force of the compressive spring means 16, pushes the carrier means 15 forwardly and laterally under the influence of the guide slot means 30 so that both the slideable guide 14 and the carrier are moved forward simultaneously. The force of the spring pushes the transporter means until such time as the transporter means 15 abuts against the stop means 17. As is apparent, the slideable guide means 14 is movable for the full longitudinal component length of the slot means 21 and 21*a* while the carrier means 15 is only forwardly movable for the longitudinal component length of the slot means 31. This is to say that the thread catching member means 11 moves independently from the thread knife and the thread nipper means 13 for a distance equal to the difference between the longitudinal components of slot means 21, 21*a* and 30.

Suitable positioning means (not shown) are provided such that the thread catcher means 11 is adapted to seize the threads formed about the looper means 3 while the latter is in its foremost position. During the return movement, towards the cutting position, the seizing member runs freely backwards toward the knife means 12 and the nipper means 13. It should be noted that the carrier means 15 and thus the knife and the nipper means carried thereby remain in the forward position shown in FIG. 3 under the influence of the spring means 16 in order to clamp and cut the threads once the thread seizing member carries the threads into engagement therewith. The carrier means 15 remains in the forward position shown in FIG. 3 until such time as the shoulder means 18 on the sliding guide means 14 abuts against the projection means 19 on the carrier means 15. By the time this abutment occurs the threads have been severed and clamped and the continued rearward motion of the reciprocal support means 15 forcibly drives the carrier means 15 along with itself rearwardly and laterally, under the influence of the angled slot means 21, 21*a* and 30 until the thread trimming mechanism has been returned to its initial non-cutting position (FIG. 1) which is removed from the linear path of motion of the looper means 3.

A slightly different embodiment of the thread trimming mechanism is shown in FIG. 3, wherein there is adjustably secured to the bed 1 of the machine a laterally adjustable guide means 40. The adjustable guide means 40 includes a depending flange means 42 which secures the guide to the machine. The guide means also includes a forwardly extending portion means 44 having an upstruck portion means 46. In this slightly different embodiment the reciprocal support means 14 is provided at its forward end means 48 with a horizontally extending portion means 50 having a guide surface 52 formed as an integral part thereof. Upon initial movement of the reciprocal support means 14, and as was discussed above, the guide assembly means 14 is forwardly and laterally moved with respect to the needle center line means 8.

As with any beam extended over a distance, the reciprocal support means 14, and more particularly the fluctuations inherent therewith, has to be controlled when extended forwardly. As was pointed out above, and as particularly applicable to multiple needle machines, it is required that the thread catching member 11 pass through the center of each of the loops formed about the looper. In order to insure that the thread catcher is accurately guided within the center of these loops the adjustable guide means 40 and more particularly the upstanding finger means 46 cooperates with the guide surface means 52 during the lateral and forward movement of the support means 14 so as to compensate for any fluctuations or tolerance fits between the slots and the bolts. The guide surface 52 is guided for its entire length against the upstruck portion means 46 and by the time the trailing end 54 on surface means 52 leaves the forward point 56 on projecting portion means 46 the thread seizing member has entered the loop nearest the knife means 12. This guiding assures the positioning of the seizing member 11 through the center of the depending thread loop formed about the looper. The purpose of the guide means being laterally adjustable is to allow the proper lateral positioning of the finger means 46 with respect to the longitudinal needle centerline and to allow for tolerances within the slots 21 and 21*a*. In this manner the finger means 46 can be preset so as to abut against the guiding surface means 52 whereby effectively cooperating with the slideable guide means 14 for accurately positioning the catcher means 11 within the thread loops.

Figure 5:
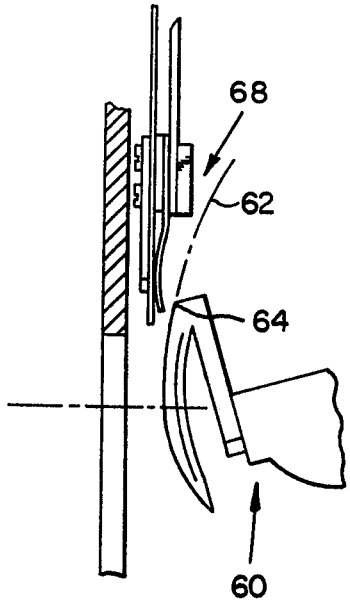
FIG. 5 is a partial cross sectional view of a typical thread severing mechanism used on industrial sewing machines.

By comparing the preferred embodiments shown in FIGS. 2 and 3 versus the standard thread trimming mechanism employed with a Union Special G.m.b.H. Class 33700 machine shown in FIG. 5, the advantages of the present invention will now be apparent. As was mentioned above, and as shown in FIG. 5, the looper mechanism means 60 on a class 33700 machine is pivotal and the looper path generally indicated as 62 of the heel 64 of the looper means 66 employed therewith is arcuate such that it drops below the thread trimming mechanism generally indicated as 68. However, as shown in FIG. 2 the path of motion of a linear moving looper means 3 would be such that the heel 70 of the looper means 3 in its rearward position, as shown in dotted lines and represented as 70' would interfere with the trimming mechanism of the present invention, for these reasons, a thread trimming mechanism generally shown as 68 that is disposed generally in a parallel aligned relationship with the looper path in FIG. 5 would not prove acceptable in view of the interfering results as shown in FIG. 2. Therefore, the present invention provides for both forwardly and lateral movement of the thread trimming mechanism so that the thread trimming mechanism may be removed from the linear path of the looper and when necessary for severance of the threads moved into parallel alignment with the path of the looper whereby assuring that all of the thread loops formed about the looper may be seized, severed and clamped whereby effectively producing an acceptable garment.

Thus it is apparent that there has been provided a thread trimming mechanism for chainstitch sewing machines that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed:

1. A thread severing mechanism for chainstitch sewing machines having a cylinder arm as workpiece rest means and a looper means which is slidable therein perpendicular to the direction of feed and parallel with the workpiece rest for loop pickup comprising:

a thread catching means movable between the looper means and the workpiece rest means;
a knife means;
a thread clamp means;
a carrier means; and
a sliding guide means connected to the thread catching means and driving said carrier means which mounts the knife means and the thread clamp means whereby upon actuation the sliding guide means and the carrier means move forwardly and to the side a predetermined distance where the carrier means is engaged and the sliding guide means thereafter moves the thread catching means into engagement with the thread.

2. A thread severing mechanism as in claim 1, wherein the sliding guide means is formed as a slide with angled guide slot means which cooperate with directional guide means whereby said forwardly and sidewardly movement is achieved.

3. A thread severing mechanism as in claim 2 wherein the directional guide means consist of bolt means.

4. A thread severing mechanism for a sewing machine having work support means, and looper means movable in a linear path, said thread severing mechanism comprising:

a thread catching means movable between the looper means and the work support means;
a knife means;
a thread clamp means;
a transporter means connected to said knife means and said thread clamp means; and
a reciprocal support means connected to said thread catching means and driving said transporter means whereby upon actuation, the reciprocal support means and the transporter means move forwardly and laterally to a predetermined point where the transporter means is engaged and the reciprocal support means thereafter moves the thread catching means into engagement with the thread.

5. The thread severing mechanism of claim 4 further including a spring means adapted to forcibly move said transporter means upon actuation of said reciprocal support means.

6. A thread severing mechanism for a sewing machine including a needle and a looper adapted to form a chain of thread, said thread severing mechanism comprising:

a reciprocal support means;
a transporter means;
a thread catching means carried by said reciprocal support means;
a knife means mounted on said transporter means for cooperative operation with said catching means;
means adapted to move said reciprocal support means and said transporter means forwardly and laterally a controlled distance whereby said transporter means is moved to a first position where the transporter means is engaged and said reciprocal support means is moved to a second position for seizing the threads.

7. A thread severing mechanism of claim 6 further including biasing means and stop means, said biasing means forcibly moving said transporter means toward said stop means.

8. The thread severing mechanism of claim 6 further including a clamping means carried by said transporter means for cooperative operation with said thread catching means and said knife means and movable to said first position and wherein the thread catching means is movably mounted between said knife means and said clamping means.

9. The thread severing mechanism of claim 6 wherein said reciprocal support means and said transporter means are mounted for cooperative movement and include means adapted to move said transporter means and said reciprocal support means into and out of a path generally parallel to and aligned with the path of said looper means.

10. The thread severing mechanism of claim 6 wherein said moving means includes means defining a slot means in said transporter means and said reciprocal support means, and bolt means secured to said machine and extending into said slot means and being slideable therealong, said slot means having longitudinal and lateral components defining the forward and lateral movement of said transporter means and said reciprocal support means.

11. The thread severing mechanism of claim 10 wherein the longitudinal component of the reciprocal support slot means is greater than the longitudinal component of said transporter alot means whereby allowing independent movement of the support means relative the transporter means.

12. In a sewing machine having a needle means and a linear moving looper means adapted to cooperatively form a series of chain stitches, and a thread severing mechanism comprising:

a knife means for cutting a thread;

a thread catching means;

means for moving said thread catching means forwardly and laterally from a first position removed from the longitudinal path of said looper means to a thread engaging position generally parallel and aligned with the path of said looper means; and means for moving said knife means into a position for cooperative operation with said thread severing means.

13. The sewing machine of claim 12 wherein said thread catching moving means in moving from said first position to said thread engaging position travels simultaneously with said knife moving means during the beginning of its stroke and during the latter part thereof travels freely, and said thread catcher moving means in returning from said thread engaging position to said first position travels freely of said knife moving means during the beginning of its stroke and during the latter part thereof drives said knife moving means toward said first position.

14. A thread severing mechanism for a sewing machine adapted to form a chain of thread, said thread severing mechanism comprising:

a reciprocal support means having a guide surface means formed as an integral part thereof;

a transporter means;

a thread catching means carried by said reciprocal support means;

a knife means mounted on said transporter means for cooperative operation with said thread catching means;

means adapted to move said support means and said transporter means forwardly and laterally until said transporter means is moved to a first position where it is engaged while said support means is moved to a second position for seizing the threads; and an adjustable guide means mounted for cooperative operation with the guide surface means on said reciprocal support means for controlling the lateral distance moved by said reciprocal support means.

* * * * *